United States Patent [19]

Byers et al.

[11] Patent Number: 4,603,525

[45] Date of Patent: Aug. 5, 1986

[54] STORAGE VESSEL

[75] Inventors: Stuart D. Byers; John F. Clark, both of Mississauga, Canada

[73] Assignee: Crophandling Systems Limited, Mississauga, Canada

[21] Appl. No.: 516,987

[22] Filed: Jul. 25, 1983

[30] Foreign Application Priority Data

Mar. 22, 1983 [CA] Canada ..... 424161

[51] Int. Cl.[4] ..... E04B 1/32

[52] U.S. Cl. ..... 52/245; 52/249; 52/506; 52/543; 220/5 A

[58] Field of Search ..... 52/80, 192–197, 52/235, 245, 249, 261, 268, 269, 506, 518, 543, 584; 220/5 A, 75, 76, 79

[56] References Cited

U.S. PATENT DOCUMENTS

| | | | |
|---|---|---|---|
| 547,155 | 10/1895 | Ogden . | |
| 737,078 | 8/1903 | Chapman | 52/519 |
| 932,243 | 8/1909 | Boll | 220/5 A |
| 1,718,519 | 6/1929 | Bayley | 52/193 |
| 1,943,191 | 1/1934 | Schwemlein | 220/5 A |
| 2,691,959 | 10/1954 | Dueringer | 52/194 |
| 2,729,313 | 1/1956 | Ernestus | 220/5 A |
| 2,953,276 | 9/1960 | Dunn | 220/5 A |
| 3,861,552 | 1/1975 | Adams | 220/5 A |
| 4,188,759 | 2/1980 | Liet et al. | 52/245 |
| 4,197,689 | 4/1980 | DeMuth | 52/245 |
| 4,240,562 | 12/1980 | Holschlag | 220/5 A |

FOREIGN PATENT DOCUMENTS

| | | | |
|---|---|---|---|
| 367766 | 2/1932 | United Kingdom | 52/506 |

OTHER PUBLICATIONS

Engineering News, Dec. 19, 1912; p. 1153.

*Primary Examiner*—John E. Murtagh
*Assistant Examiner*—Andrew Joseph Rudy
*Attorney, Agent, or Firm*—Donald E. Hewson

[57] ABSTRACT

A storage tank, such as a water tower is disclosed, made by bolting rows of glass-coated steel plates together. The plates overlap each other side to side and above and below. The contact with plates at the diagonal corners is not an overlapping contact but an abutment contact, and the lines of abutment contact are staggered row to row. This arrangement leads to a very efficient use of material, and to an inherently leak proof structure when the plates are arranged to form a double skin in the lower regions of the tower.

1 Claim, 5 Drawing Figures

STORAGE VESSEL

This invention relates to bulk storage vessels, particularly to water storage tanks or towers.

BACKGROUND TO THE INVENTION

It is common practice to make water tanks, or towers, from sheet steel plates. However, to construct a very tall tower where there are significant hydraulic pressures in the lower part of the tower, it has been the usual case to make the tower double-skinned at the bottom. Hitherto it has been practicable to make a double-skinned tower only if the tower is of welded construction. Welding is very expensive however since skilled operators are required, and the need to stress-relieve the welds poses further limitations.

One of the problems with bolting plates together is that the ends of the bolts protrude. The tower constructor cannot simply bolt a set of plates to encircle an existing set: the plates must be interleaved together if he wishes to provide an effective double-skinning arrangement by bolting.

An advantage of bolting is that the plates can be pre-finished. Glass-coating the steel is a very effective protection for water storage tanks: the glass coating is applied to both sides of the plates and provides a very hard inert barrier (about 0.008 inches thick) of silica glass, which is chemically and mechanically bonded to the steel.

Another problem though with bolting is that not all the edges of the plates can be overlapped and bolted tightly together. Not, at least, if the overlapping is to occupy only a margin at the edge of the plates, and also not if a gap or space between the plates is to be avoided. A further problem is that where the edges of the plates are in abutment, a potential leakpath arises, which must be accounted for.

PRIOR ART

In the prior art, U.S. Pat. No. 3,861,552, Adams (Jan. 21, 1975) shows a welded tower with a double skin at the bottom. U.S. Pat. Nos. 2,953,276 Dunn (Sept. 20, 1960); 4,188,759 Liet (Feb. 19, 1980), and 4,197,689 Demuth (Apr. 15, 1980) all show bolted towers, but as mentioned above, none show how it might be possible to impart a double-skinned arrangement at the bottom of the tower. Also, flanges as shown for bolting the plates together cannot serve in a double-skinned arrangement. A tower with a single-skinned arrangement over its whole height is shown in U.S. Pat. No. 2,729,313 (Ernestus, Jan. 3, 1956).

BRIEF DESCRIPTION OF THE INVENTION

The invention provides a storage vessel or tower, such as a tall water tank, with a double skin at the bottom. It provides the double skin with a minimum of extra plate thicknesses. (Triple and quadruple thickness is inevitable at some of the joints). The invention also provides a long length of abutment where abutment is necessary between the plates; the longer the length the easier it is to provide an inherently reliable seal against high hydrostatic water pressures.

The invention does this by staggering the plates and abutting them over the overlapped length, as will be explained in more detail hereafter. A plate overlaps the plates directly alongside and directly above and below; and the plate also abuts, but does not overlap, the plates which are diagonal relative to it. In the usual mode of assembly, as practised by this invention, it is the plates in the relatively top right and bottom left positions, as viewed from the outside of the tower, that are overlapped. Of course, the opposite mode of overlap may also be practised, without departing from the present invention, so long as the direction of overlapping is consistent in all levels of plate as they are assembled.

By adjusting the degree of vertical overlap, a single or a double skin may be provided: the abutment lengths in the double-skinned part may be long for inherent protection against leaks; there are no vertical spaces or voids present between any overlapping plates; and only a minimum of triple and quadruple thicknesses need be provided. We have discovered that there is an arrangement of overlapping and abutting the plates that leads to the stated benefits. Most attempts to achieve double skinning are found to have one or other of the problems that are avoided by the present invention.

The way in which these advantages are provided for by the invention will become apparent from the description below of a specific embodiment of the invention.

It is convenient for the plates of the water tower to be all the same size and shape. The holes for the bolts, of course, must be formed before the plate is given its glass coating. Apart from that restriction, there is no difficulty in providing plates with different patterns of holes one to another. In any event, it will be evident to the skilled practioner that the holes in the plates are normally punched using trapezoidal punching patterns, where the rows of holes on the vertical edges of each plate are not parallel but the rows are slightly wider apart at the top than at the bottom—they slope outwardly—and where the distance between holes in the top margin is slightly greater than in the bottom margin; all so as to accommodate the overlap of plates and so as to maintain a constant diameter of the tower as it is assembled. Also, the plates may be of different thicknesses, with the thickest at the bottom, gradually reducing in thickness until only a single skin is needed, then the single skin too may be of reducing thickness up to the top of the tower. The plates are preferably curved to the profile of the tower.

An exemplary embodiment of the invention will now be described with reference to the accompanying drawings.

DESCRIPTION OF THE PREFERRED EMBODIMENTS

Figure 1:
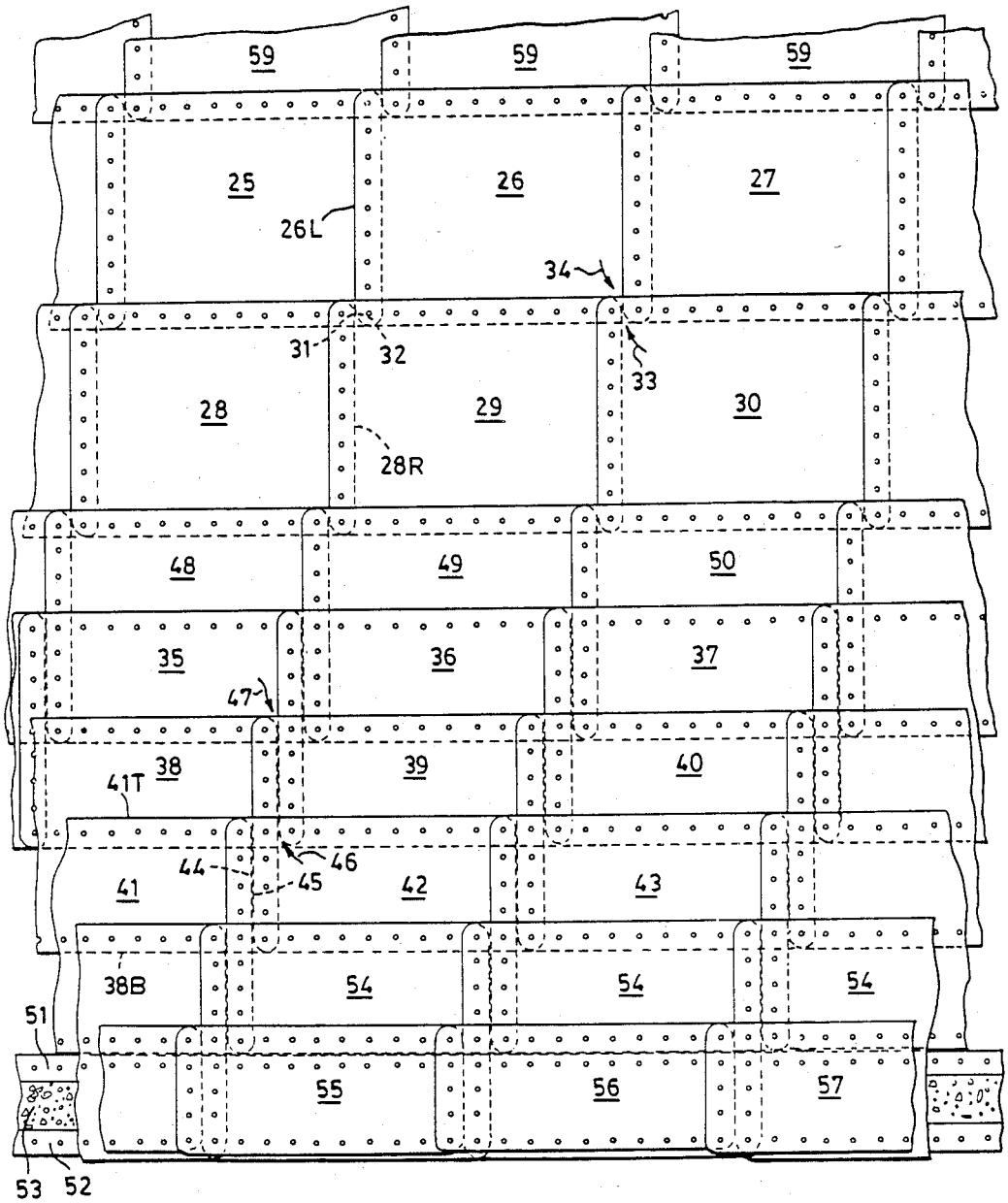
FIG. 1 shows a side elevation of part of a cylindrical water tower made of plates.
Figure 2:
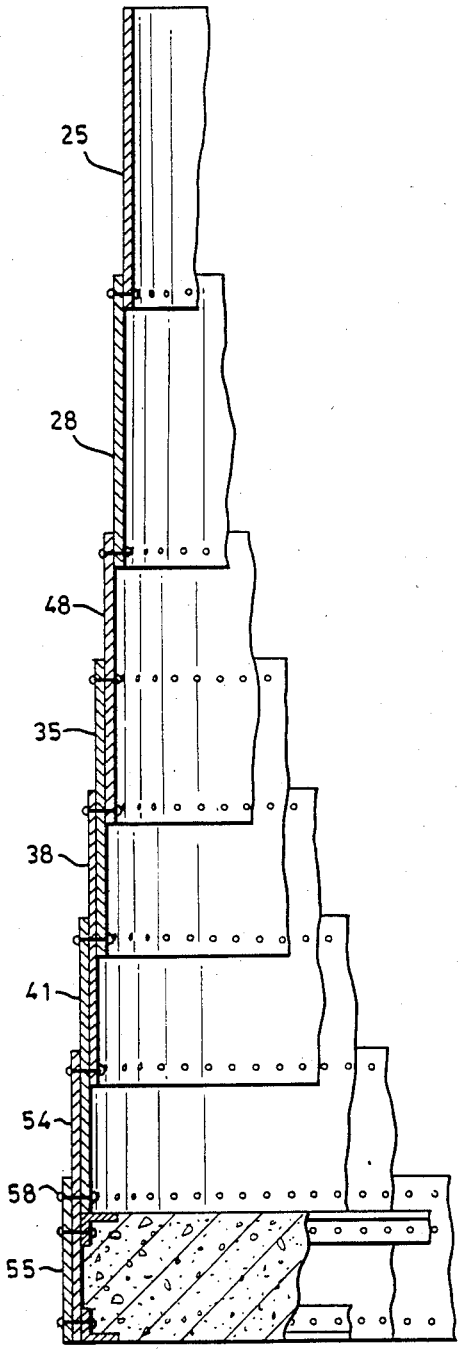
FIG. 2 is a section through part of the tower of FIG. 1.

The plates that make up the tower are placed in the abutting and overlapping relationship that is shown in FIGS. 1 and 2.

The plates shown are all the same rectangular shape and size. The dispositions of holes formed in the plates, however, are not all the same. In the following discussion, which relates to the drawings showing plates and assembly of plates as illustrated, it will be understood the designations "left" and "right" can be read in reverse; i.e., "right" and "left", whereby the plates and assembly of plates would be substantially the mirror image of that which is illustrated.

Figure 3:
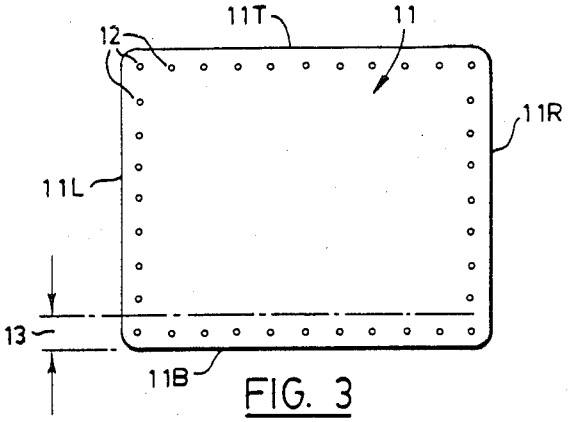
FIGS. 3, 4 and 5 are elevations of plates used in the tower of FIG. 1.

FIG. 3 shows a plate 11 of a set of plates termed the singles set. The plate 11 has a respective margin contiguous with its top 11T, bottom 11B, left hand side 11L, and right hand side 11R, edges. Regularly pitched bolt holes 12 are disposed in these margins. Normal engineering practice provides that a bolt hole should be positioned in from the edge of a plate by a distance that is no less than the diameter of the hole, and that practice is followed here. The margin is the area which comes under the direct action of bolts placed in the holes, and thus may be regarded as extending from the appropriate edge of the plate a distance inwards some two or three times the diamter of the hole. The width of a margin is typically of the proportions shown in FIGS. 3 at 13.

Figure 4:
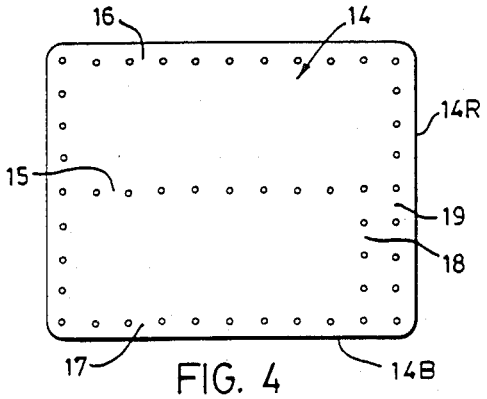

FIG. 4 shows a plate 14 of a set of plates termed the transition set. The plate 14 has holes in the margins, like the plate 11. In addition, the plate 14 has a middle row 15 of holes disposed midway between the top 16 and bottom 17 rows of holes. Also, the plate 14 has a column 18 of holes disposed adjacent to and parallel to the holes 19 in the margin contiguous with the right hand edge 14R, the column 18 of holes extending from the middle row 15 down to the row 17 of holes in the margin contiguous with the bottom edge 14B.

Figure 5:
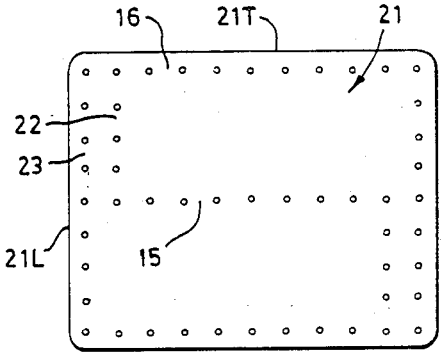

FIG. 5 shows a plate 21 of a set of plates termed the doubles set. The plate 21 has all the holes of a plate 14 of the transition set, and in addition it has a column 22 of holes disposed adjacent to and parallel to the holes 23 in the left hand margin 21L, the column 22 of holes extending from the row 16 of holes in the top margin 21T down to the middle row 15.

Returning to FIGS. 1 and 2, a row of places 25, 26, 27 . . . forms a complete ring or band, several of these rings being required to build the whole tower. The plates 25, 26, 27 . . . are from the singles set, as are the plates 28, 29, 30 . . . in the row below. The plates forming one of the rows are in simple overlapping relationship; that is, the right hand margin of one plate 28 just, and only just, covers the left hand margin of the next plate 29. The two plates 28, 29 directly overlap each other, in that they are in actual contact (apart from a jointing compound placed in the contact area) and there is no other place between them.

Similarly, a plate 28 directly overlaps the plate 25 above it, but now the bottom margin of the plate 25 is staggered with respect to the top margin of the plate 28. A top portion 31 of the right hand edge 28R of the plate 28 is, because of the extent of the stagger, in direct edge to edge abutment with a bottom portion 32 of the left hand side edge 26L of the plate 26. It can be seen that the height of the direct overlap between the plates 25 and 28, and also, and as a consequence, the heights of the top 31 and bottom 32 portions, are equal to the width 13 of the margin.

It will be noted that all of the overlapped joints can be made tight by careful tightening of the bolts through the appropriate holes. However, the abutment between the portions 31 and 32 is a potential leakpath, that cannot be sealed by tightening the bolts. Such a potential leakpath is indicated by the arrows 33, 34 in FIG. 1. If the jointing compound that seals the leakpath 33, 34 should fail, the joint would leak and it could be quite difficult to repair it. On the other hand, at the top of the tank, as indicated, the water pressure is quite low, and the tendency thereafter is only slight for the water to extrude compound out of the leakpath 33, 34, even if the compound deteriorates.

Further down the tank, the water pressure is higher and a leakpath such as that shown at 33, 34 becomes increasingly more prone to failure. In addition, of course, further down the tank the higher pressure means that the stresses in the plates become higher.

Thus, the lower part of the tank has a double skin, with the long abutment feature that is made possible by the present invention, and that provides an inherently leakproof structure.

The plates 35, 36, 37 . . . are from the doubles set, as are the plates 38, 39, 40 . . . in the row below, and the plates 41, 42, 43, . . . in the row below that.

The plates in any one row, such as the plates 35, 36, 37, . . . are in direct overlapping relationship, in that the left hand margin of one plate 36 just, and only just, covers the right hand margin of the next plate 35. Similarly, a plate 41 directly overlaps the plate 38 above it, but now the, overlapping portion is much greater than simply the width of the margin, in that the area of the overlap between the plates 41 and 38 extends from the top edge 41T to the bottom edge 38B, a distance equal to half the height of the plates, plus the width of a margin, as may be seen in FIG. 1.

Now, the height of the direct overlap between the plates 41 and 38 determines also the height of the top 44 and bottom 45 portions of the edges of the respective plates 41 and 39 that are in direct edge-to-edge abutment with each other, so that the left hand edge of the plate 39 and the right hand edge of the plate 41 abut each other over a length of half the height of a plate plus the width of a margin.

Since this same degree of overlap is present between the plate 38 and the plate 35 above it, the bottom margin of plate 35 overlaps the top margin of the plate 41, the overlap having a height equal to the width of a margin. It should be noted that this overlap is only indirect in that, of course, the plate 38 passes between, and separates, the plates 35 and 41.

The effect of this double ovrlapping, coupled with the staggering of the plates row-to-row, is that the potential leakpath at the abutment is very long. The potential leakpath is indicated by the arrows 46, 47 in FIG. 1. Not even the most deteriorated compound will tend to extrude through a path that long, under the available water pressure. The leakpath may be made longer still by forming the abutting (vertical) edges of the plates in a jagged or sawtooth manner.

The plates 48, 49, 50, . . . are from the transition set, and there is only one row of those plates. The manner in which the plates 48, 49, 50, . . . provide a transition between the plates 28, 29, 39, . . . and the plates 35, 36, 37, . . . may be easily inferred from FIG. 1.

The construction of the tower, including the assembly of plates having various overlapping or surface-to-surface contacts as discussed above, is more fully understood with reference to the following description of the method of erecting the tower.

Following the placement of footings and anchor bolts, at a sufficient depth in the ground as may be determined by local conditions—the footings and anchor bolts are not shown—the foundation ring or base ring of plates 54 is assembled, leveled and made round. Rounded angles 51 and 52 are assembled to the base ring plates 54, the lower rolled angles 51 are secured to the anchor bolts, and a concrete foundation plinth 53 is cast, up to the level of the top of rolled angle 52. The concrete is then left to cure, for a period of three to twenty eight days, and it is the usual case that further construction does not continue until after twenty-eight days, by which time the concrete has fully set up. However, because the concrete may have shrunk to some extent as it has cured, it is usual that hollow bolts are used to secure the rolled angle 51 to the base ring plates 54, so that additional mastic may be pumped or extruded to the hollow bolts against the concrete in any voids that may then exist. At the same time, the reinforcing plates 55, 56, 57, . . . are put into place, and they may extend substantially to the bottom of the plinth as shown, or they may extend only part way down the plinth from the top, provided that they extent above the level of the plinth for bolting into the row of holes at the level 58.

After the concrete of the plinth has cured, a row of plates 25, 26, 27, . . . is assembled and formed into a ring by overlapping the edges and bolting them together. At this time, the roof having plates 59 may also be assembled, or it may be that the row of plates 25, 26, 27, . . . comprises the top of the tank and that no other plates or roof structure may be assembled. In any event, after the plates 25, 26, 27, . . . are formed into a ring, jacks (not shown) raise the ring until plates 28, 29, 30, . . . can be brought into place on the plinth 53 and fitted to the plates 25, 26, 27, . . . in the manner shown in FIG. 1, both as to vertical height, and as to orientation to achieve the staggered effect as described above.

More rings are added, by jacking up the already assembled rings and fixing the new rings underneath, until the tower is as high as desired. The rings at the bottom are double-overlapped to provide the benefits of the invention as described.

As can be seen from FIGS. 1 and 2, the plates 41, 42, 43, . . . are the last or tie-in ring to be placed. However, the base ring which comprises plates 54 is not reinforced by a double skin just at the bottom of the tie ring 41, 42, 43, . . . ; and therefore, the reinforcing belt comprising the half- or smaller- sized plates 55, 56, 57, . . . is in place to provide the additional skin thickness as required at the bottom of the tower.

There has been described a water tower or other storage structure that may be made from a plurality of preformed sheets of steel, and which may be bolted (or otherwise fastened, but not welded) together in the place where it will stand. Such structures as are provided by the present invention may be dis-assembled at a later time; a feature which would be substantially impossible with a welded structure. Moreover, a structure which is assembled according to the present invention, especially when made with glass-coated steel and approved mastic or other sealant, may be used for potable water without additional treatment, and without the necessity for occasional cleaning or other repair, as would be necessary for a non-glass lined tank.

Storage towers of great height can be constructed according to the present invention; and where glass-coated plates are used, there is considerable stickion between the plates, so that the structure is very secure.

Other details of construction may change from the above discussion, which is for purposes of illustration only and is not restrictive, without departing from the spirit and scope of the appended claims.

What is claimed is:

1. A cylindrical storage vessel for water and other fluids which create high hydrostatic pressures, comprising:

a vertical cylindrical wall having a thickness formed of a plurality of flangeless plates, each of substantially the same height, and each being substantially rectangular and having series of holes in margins which are contiguous with its respective upper margin, lower margin right-hand and left-hand edge margins edges; and a horizontal foundation;

each of said plates having a lower portion and an upper portion, and an inner surface and an outer surface;

said storage vessel being assembled by fastening said plates together using headed fasteners passing through holes in at least two overlapping plates, in each instance;

where said vessel comprises a plurality of rows of plates, where each successive higher row of plates is placed so that at least a lower outer surface portion of each row contacts a higher inner surface portion of a next successive lower row of plates;

said vessel being so constructed that in its lower portion the wall thickness thereof comprises at least two thicknesses of said plates, where said plates are placed in the following manner:

a first row of plates is a lowermost row in said a lower portion of said vessel, there are a plurality of intermediate rows of plates in said lower portion of said vessel, and there is an uppermost row of plates in said lower portion of said vessel;

each of said plates in each intermediate row of plates is placed so that its upper inner surface is in surface-to-surface contact with at least the a lower half of the a lower outer surface of a next successive higher row of plates, and its lower outer surface is in surface-to-surface contact with at least an upper half and upper inner a next successive lower row of plates;

the left-hand and right-hand edges of each of said plates in each row of plates are marginally staggered with respect to the left-hand and right-hand edges of each of the plates in the next successive higher and lower rows of plates, respectively; so that for each row of plates the upper portion of the right-hand edge of each plate thereof is in edge-to-edge contact with the lower portion of the left-hand edge of a plate in the next successive higher row of plates;

and in said lower portion of said vessel, from the upper margin of said lowermost row of plates to the lower margin of said uppermost row of plates in said lower portion of said vessel, the successive rows of plates are so placed that there are three thicknesses of plates at each the upper margin of a first lower row of plates; comprising said upper margin, an intermediate portion of the first next successive higher row of plates, and the lower margin of the second next successive higher row of plates;

where said fasteners pass through said series of holes in said upper margin of the first lower row of plates, and thence through a series of holes in the intermediate portion of the first next successive higher row of plates, and thence through said series of holes in said lower margin of said second next successive higher row of plates; and also through the series of holes at the right-hand and left-hand margins of said plates, and such additional holes near the right-hand and left-hand margins in the upper and lower portions thereof as are necessary to accommodate said fasteners passing through said three thicknesses of plates at said margins;

and where the wall of said vessel in its upper portion above said lower portion comprises only a single thickness of plates except where the marginal edges of the plates in any one row marginally overlap the edges of the next contiguous plates in that same row, and where the upper margins of the plates in any one row marginally overlap the bottom margins of the plates in the next successive higher row of plates.

* * * * *